US010870469B2

(12) United States Patent
White

(10) Patent No.: US 10,870,469 B2
(45) Date of Patent: Dec. 22, 2020

(54) INFLATABLE SURVIVAL VEST

(71) Applicant: Frank White, Saanichton (CA)

(72) Inventor: Frank White, Saanichton (CA)

( * ) Notice: Subject to any disclaimer, the term of this patent is extended or adjusted under 35 U.S.C. 154(b) by 0 days.

(21) Appl. No.: 16/645,507

(22) PCT Filed: Aug. 30, 2018

(86) PCT No.: PCT/CA2018/051049
§ 371 (c)(1),
(2) Date: Mar. 9, 2020

(87) PCT Pub. No.: WO2019/051584
PCT Pub. Date: Mar. 21, 2019

(65) Prior Publication Data
US 2020/0277033 A1 Sep. 3, 2020

(30) Foreign Application Priority Data
Sep. 12, 2017 (CA) ..... 2978848

(51) Int. Cl.
*B63C 9/18* (2006.01)
*B63C 9/125* (2006.01)
(Continued)

(52) U.S. Cl.
CPC ..... *B63C 9/1255* (2013.01); *A41D 1/04* (2013.01); *A41D 13/012* (2013.01); *B63C 9/18* (2013.01); *B63C 9/24* (2013.01)

(58) Field of Classification Search
CPC ..... B63C 9/24; B63C 9/18; B63C 9/1255; A41D 1/04; A41D 13/012
See application file for complete search history.

(56) References Cited

U.S. PATENT DOCUMENTS 1,754,342 A 4/1930 Tubiolo
3,337,887 A 8/1967 Barnier
(Continued)

FOREIGN PATENT DOCUMENTS

DE 88 01 870 U1 7/1988
EP 0615899 A2 9/1994
(Continued)

OTHER PUBLICATIONS

International Search Report Corresponding to PCT/CA2018/051049 dated Nov. 19, 2018.
(Continued)

*Primary Examiner* — Stephen P Avila
(74) *Attorney, Agent, or Firm* — Davis & Bujold PLLC; Michael J. Bujold

(57) ABSTRACT

An inflatable survival vest includes an inflatable bladder having an inflation inlet through which a gas is input to inflate the bladder. The bladder is configured in the shape of a vest. The bladder has a plurality of parallel seams that divide the bladder into tubular channels. The tubular channels cause the vest to have a wavy outwardly facing surface with crests and troughs and a wavy inwardly facing surface with crests and troughs. An inner air chamber is positioned along the inwardly facing surface of the bladder. A shell with limited stretch-ability overlies the inflatable bladder, thereby limiting outward expansion of the bladder such that the bladder is adapted to expand inwardly pressing the inner air chamber against a body of a person wearing the bladder.

10 Claims, 15 Drawing Sheets

(51) Int. Cl.

| | |
|---|---|
| ***A41D 13/012*** | (2006.01) |
| ***B60C 29/00*** | (2006.01) |
| ***A41D 1/04*** | (2006.01) |

(56) References Cited

U.S. PATENT DOCUMENTS

| | | | | |
|---|---|---|---|---|
| 3,931,657 | A | 1/1976 | Jones | |
| 4,060,867 | A | 12/1977 | Miller | |
| 4,242,769 | A * | 1/1981 | Rayfield | A41D 13/002 441/91 |
| 4,416,641 | A * | 11/1983 | Spinosa | A41D 13/0125 441/107 |
| 4,523,914 | A | 6/1985 | Faulconer et al. | |
| 4,561,853 | A | 12/1985 | Faulconer et al. | |
| 4,865,573 | A | 9/1989 | Switlik, Jr. et al. | |
| 5,338,239 | A * | 8/1994 | Cleaveland | B63C 9/1255 441/106 |
| 5,494,469 | A | 2/1996 | Heath et al. | |
| 5,603,647 | A | 2/1997 | Van Adrichem et al. | |
| 5,839,933 | A | 11/1998 | Daivs, Sr. et al. | |
| 6,415,453 | B1 | 7/2002 | Anderson et al. | |
| 6,883,185 | B2 | 4/2005 | Duncan | |
| 7,699,679 | B2 | 4/2010 | Lahyani | |
| 7,958,888 | B2 | 6/2011 | Wagner, III | |
| 9,067,658 | B2 | 6/2015 | Hughes | |
| 9,775,389 | B2 * | 10/2017 | Azzolin | A41D 1/04 |
| 2004/0031090 | A1 | 2/2004 | Duncan | |
| 2008/0188149 | A1 | 8/2008 | Curry | |
| 2016/0068241 | A1 | 3/2016 | LeBlanc et al. | |

FOREIGN PATENT DOCUMENTS

| | | | |
|---|---|---|---|
| WO | 92/03332 | A1 | 3/1992 |
| WO | 2009/040844 | A2 | 4/2009 |

OTHER PUBLICATIONS

Written Opinion Corresponding to PCT/CA2018/051049 dated Nov. 19, 2018.

Jennifer Woodson, "Spacer Fabrics Utilized in Active Wear", Apr. 15, 2009, pp. 1-22.

* cited by examiner

INFLATABLE SURVIVAL VEST

FIELD

There is described an inflatable survival vest.

BACKGROUND

U.S. Pat. No. 4,060,867 (Miller) titled "Inflatable Life Vest; U.S. Pat. No. 4,865,573 (Switlik Jr. et al) titled "Inflatable Life Vest Of The Single-Attachment, Single-Adjustment Type"; U.S. Pat. No. 5,494,469 (Heath et al) titled "Inflatable Life Vest" and U.S. Pat. No. 9,067,658 (Hughes) titled "Inflatable Swim Vest" are all examples of inflatable vests.

SUMMARY

There is provided an inflatable survival vest which includes an inflatable bladder having an inflation inlet through which a gas is input to inflate the bladder. The bladder is configured in the shape of a vest. The bladder has a plurality of parallel seams that divide the bladder into tubular channels. The tubular channels cause the vest to have a wavy outwardly facing surface with crests and troughs and a wavy inwardly facing surface with crests and troughs. An inner air chamber is positioned along the inwardly facing surface of the bladder. A shell with limited stretch-ability overlies the inflatable bladder, thereby limiting outward expansion of the bladder such that the bladder is adapted to expand inwardly pressing the inner air chamber against a body of a person wearing the bladder.

When the inflatable survival vest described above is inflated and the inner liner is pressed into contact with the body of the person wearing the bladder, it eliminates gaps through which cold water or cold air would otherwise enter. The air located in inner air chamber also provides some insulation benefit, which helps retain core body temperature.

Although beneficial results may be obtained through the use of the inflatable survival vest described above, when cold water (or cold air) is in contact with the outer layer for a prolonged period of time, the temperature of the inflatable bladder avoidably drops, as does the temperature of insulating air located in the inner air chamber. Even more beneficial results may be obtained when a circulation inlet is provided into and an exhaust outlet is provided out of the inner air chamber. This enables a breath input device to be connected to the circulation inlet and breath from the person wearing the vest circulated through the inner air chamber from the circulation inlet to the exhaust outlet. The heat from the person's breath slows the decrease in the temperature of the inner air chamber, thereby delaying the onset of hypothermia.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
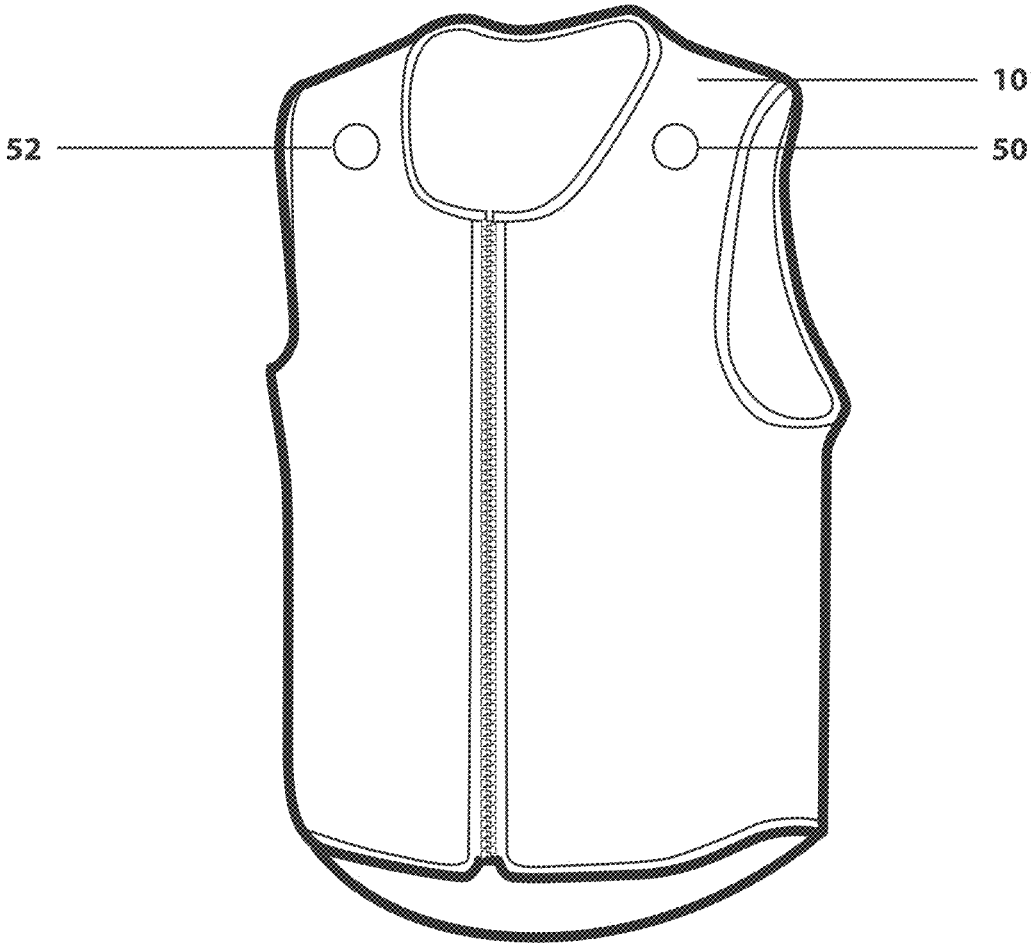
FIG. 1 is a front elevation view of a first embodiment of inflatable survival vest.

A first embodiment of inflatable survival vest generally identified by reference numeral 10, will be described with reference to FIG. 1 through 2B. A second embodiment of inflatable survival vest generally identified by reference numeral 100, will be described with reference to FIG. 3 through 3B. A snorkel breathing apparatus that can be used with first embodiment 10 or second embodiment 100 will be described with reference to FIG. 4 and FIG. 4A. A third embodiment of inflatable survival vest generally identified by reference numeral 150, will be described with reference to FIG. 5 and FIG. 5A.

Figure 2:
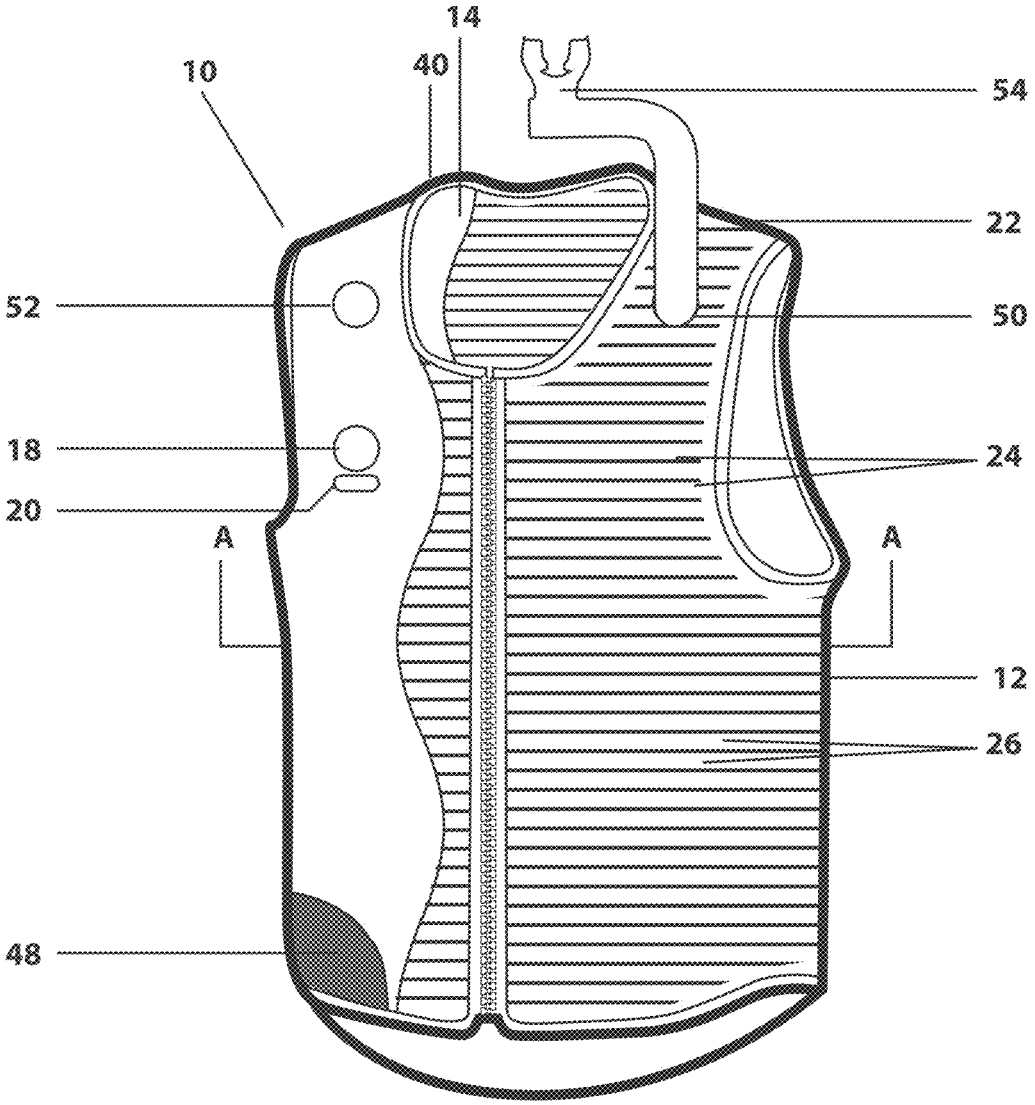
FIG. 2 is a front elevation view in partial section of the first embodiment of inflatable survival vest of FIG. 1.
Figure 2A:
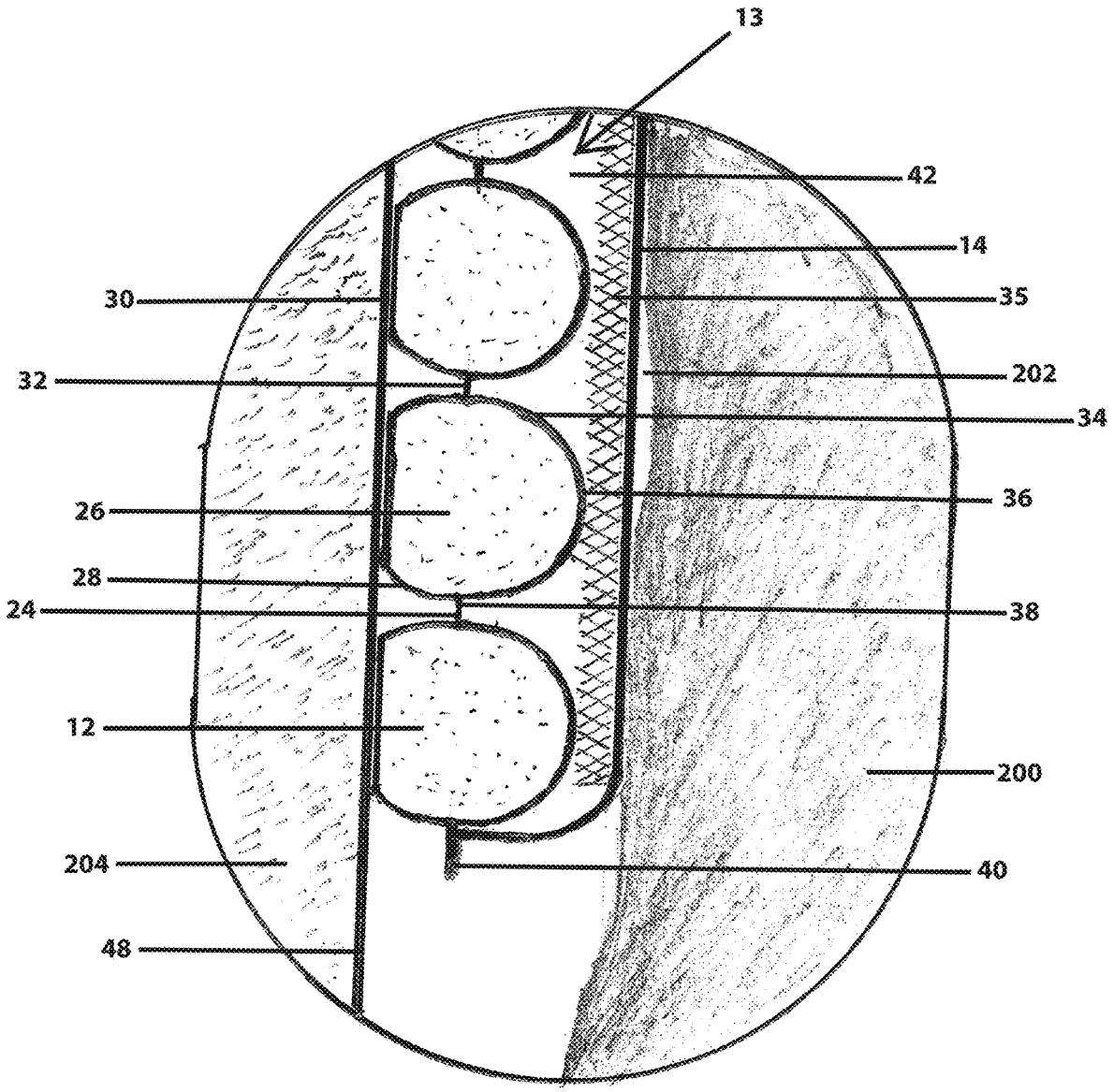
FIG. 2A is a section view of the first embodiment of inflatable survival vest of FIG. 2, when inflated.

Structure and Relationship of Parts:

Referring to FIG. 2A, inflatable survival vest 10 consists of an inflatable bladder 12 and an inner air chamber 13 covered by an air retaining inner layer 14. Referring to FIG. 2, inflatable bladder 12 has an inflation inlet 18 through which a gas is input to inflate inflatable bladder 12. Inflation inlet 18 is shown having a gas cylinder 20 connected to it, which is used to rapidly inflate inflatable bladder 12 in the event of an emergency. It will be appreciated that inflatable bladder 12 may also have a simple blow tube through which air can be input in the event that the automated inflation fails. Inflatable bladder 12 is configured in the shape of a vest, generally indicated by reference numeral 22. Inflatable bladder 12 has a plurality of parallel seams 24 extending vertically that divide inflatable bladder 12 into tubular channels 26. Referring to FIG. 2A and FIG. 2B, tubular channels 26 cause vest 22 to have a wavy outwardly facing surface 28 with crests 30 and troughs 32 and a wavy inwardly facing surface 34 with crests 36 and troughs 38.

Figure 2B:
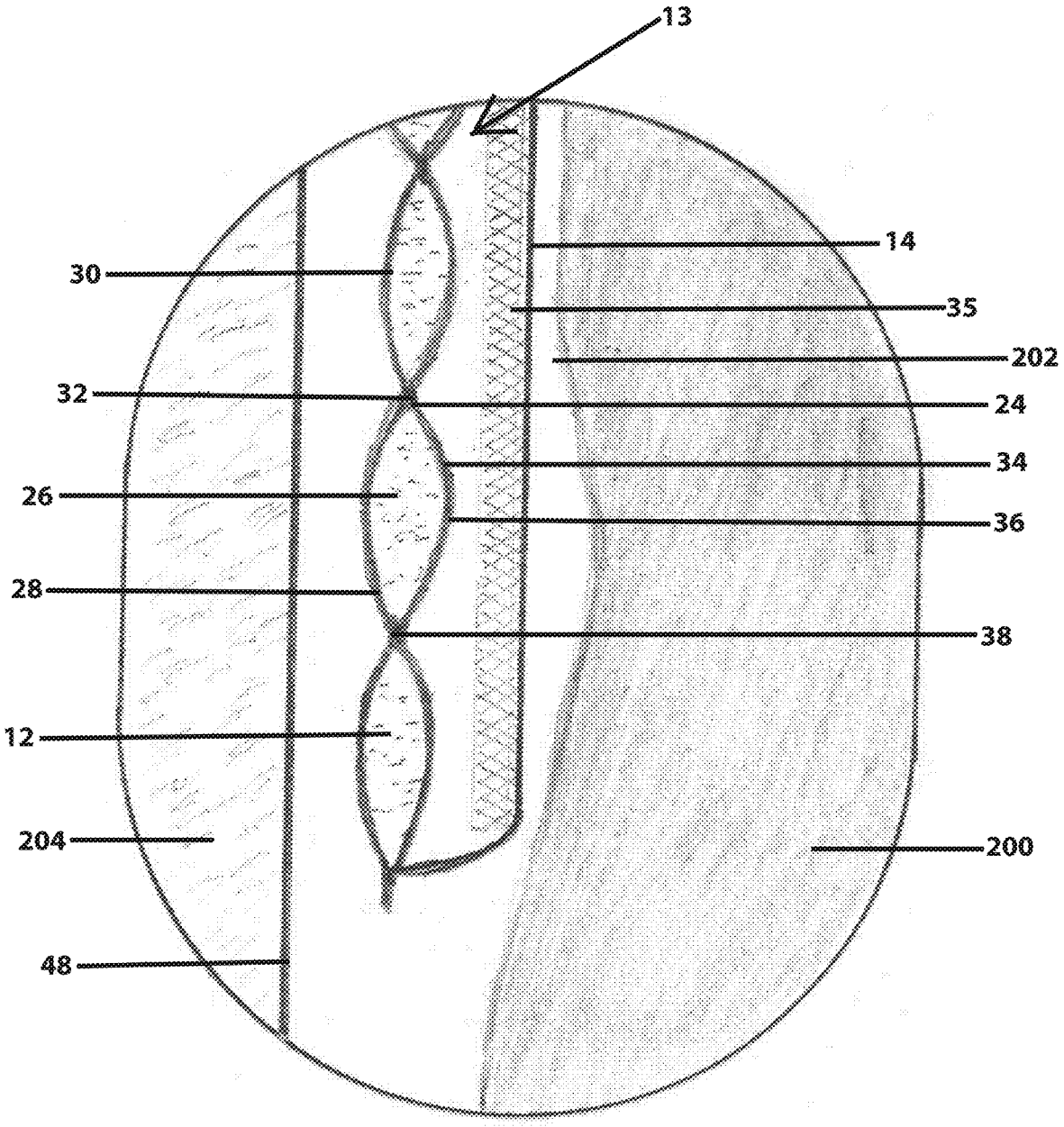
FIG. 2B is a section view of the first embodiment of inflatable survival vest of FIG. 2, when deflated.

Referring to FIGS. 2, 2A and 2B, inner layer 14 has a peripheral edge 40. Inner layer 14 is secured along peripheral edge 40 to inflatable bladder 12. Referring to FIG. 2A, when inflatable bladder 12 is inflated, inner layer 14 overlies crests 36 of wavy inwardly facing surface 34 of vest 22 and forms a plurality of inner air channels 42 in troughs 38 between inner layer 14 and wavy inwardly facing surface 34. In the illustrated embodiment, a porous non-compressible filler material 35 is used to fill inner air chamber 13 or at the very least placed adjacent to inner layer 14. The advantage of using filler material 35 is that it is non-compressible to ensure that inner air chamber 13 does not get choked off Air passes freely through filler material 35. There are various filler materials 35 that can be used. Beneficial results have been obtained through the use of "spacer fabrics", which are open, three dimensional knit fabrics. There spacer fabrics are available through suppliers, such as Gehring-Tricot. Beneficial results have also been obtained through the use of PVC coil fabrics, presently sold as carpet mats. These PVC coil fabrics are available in rolls through suppliers, such as Binzhou Worldking.

Referring to FIG. 2, a shell 48 a shell with limited stretch-ability overlies inflatable bladder 12. Referring to FIG. 2A, shell 48 has limited stretch-ability and limits outward expansion of inflatable bladder 12. This serves to direct expansion of inflatable bladder 12 inwardly, forcing inner air chamber 13 against body 200.

Referring to FIG. 2, a circulation inlet 50 is provided into and an exhaust outlet 52 is provided out of inner air channels 42 of inner air chamber 13 (as shown in FIG. 2A). A breath input device, such as mouthpiece 54, is connected to circulation inlet 50. An exhaust valve forms part of exhaust outlet 52. The exhaust valve discharges excess air externally of inner air chamber 13. The exhaust valve is a one way valve that is pressure activated to open when the pressure exceeds pre-set limits. When the exhaust valve is closed, it prevents the entry of water. When the exhaust valve is open, the release of air prevents entry of water. The exhaust valve will not be further described, as suitable exhaust valves are known in the art and are commercially available. One example of a commercially available exhaust valve are the exhaust valves manufactured in various sizes for various applications under the Trademark brand SI-TECH.

Operation:

Referring to FIG. 2, vest 22 is intended to be worn in a normally deflated condition. Referring to FIG. 2, when vest 22 is immersed in water gas cylinder 20 is used to rapidly inflate inflatable bladder 12 within vest 22. Gas cylinder 20 can be manually activated or a liquid sensor can be provided with a valve that automatically causes gas cylinder to open the valve to inflate inflatable bladder 12 when liquid is sensed by the liquid sensor. Automated systems using liquid sensors are well known and, for that reason, will not be further described. It will be appreciated, that a simple blow tube can be used to inflate inflatable bladder 12. The manner of inflating inflatable bladder 12 is not essential to the present invention.

Referring to FIG. 2A, once inflatable bladder 12 is inflated, some immediate benefits are achieved. Firstly, expansion of inflatable bladder 12 forces inner layer 14 against a body 200 of a wearer. This eliminates or at the very least reduces gaps 202 through which cold water 204 (or in land applications cold air) can circulate. A preferred material for inner layer 14 is neoprene. The use of shell 48 that has limited stretch-ability and limits outward expansion of inflatable bladder 12, serves to assist in directing expansion of inflatable bladder 12 inwardly forcing inner layer 14 against body 200, thereby making the seal more effective. Secondly, air is positioned in inner air channels 42. This air has some insulation value.

Referring to FIG. 2A, when a person is immersed in cold water for a prolonged period of time, the cold water 204 will cool the air positioned in outer air channels 46. This cold temperature will be transmitted to body 200 and the core temperature of the person will decrease, resulting eventually in death. Referring to FIG. 2, a person wearing vest 22 is able to exhale into mouthpiece 54. Breath exhaled through mouthpiece 54 enters circulation inlet 50 and passes to exhaust outlet 52. Referring to FIG. 2A, breath input into circulation inlet 50 (as shown in FIG. 2) is circulated through inner air channels 42 exiting exhaust outlet 52 (see FIG. 2). Warm breath passing along inner air channels 42 serves to warm body 200 and slows the decrease in core temperature.

Figure 3:
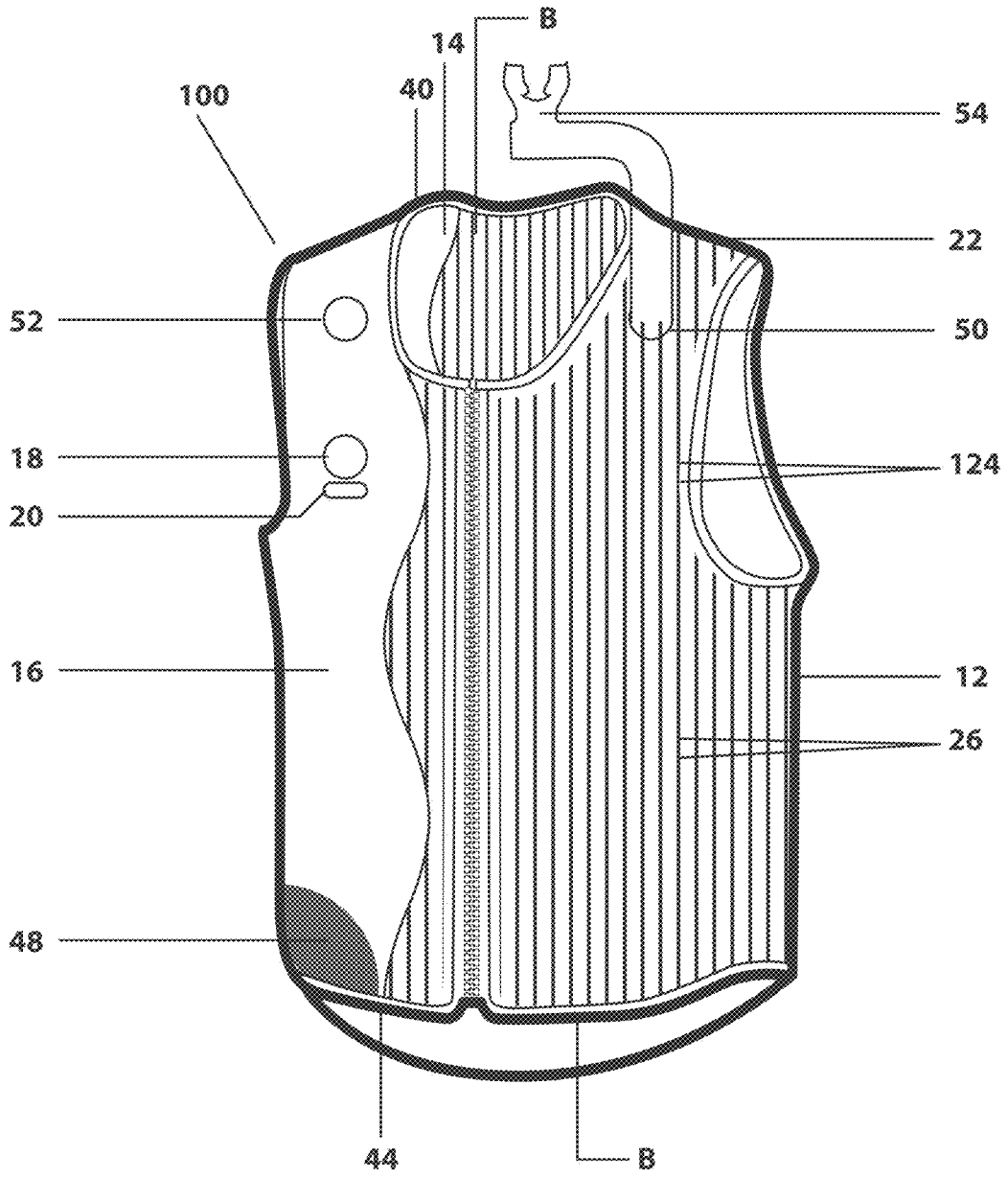
FIG. 3 is a front elevation view in partial section of a second embodiment of inflatable survival vest.
Figure 3A:
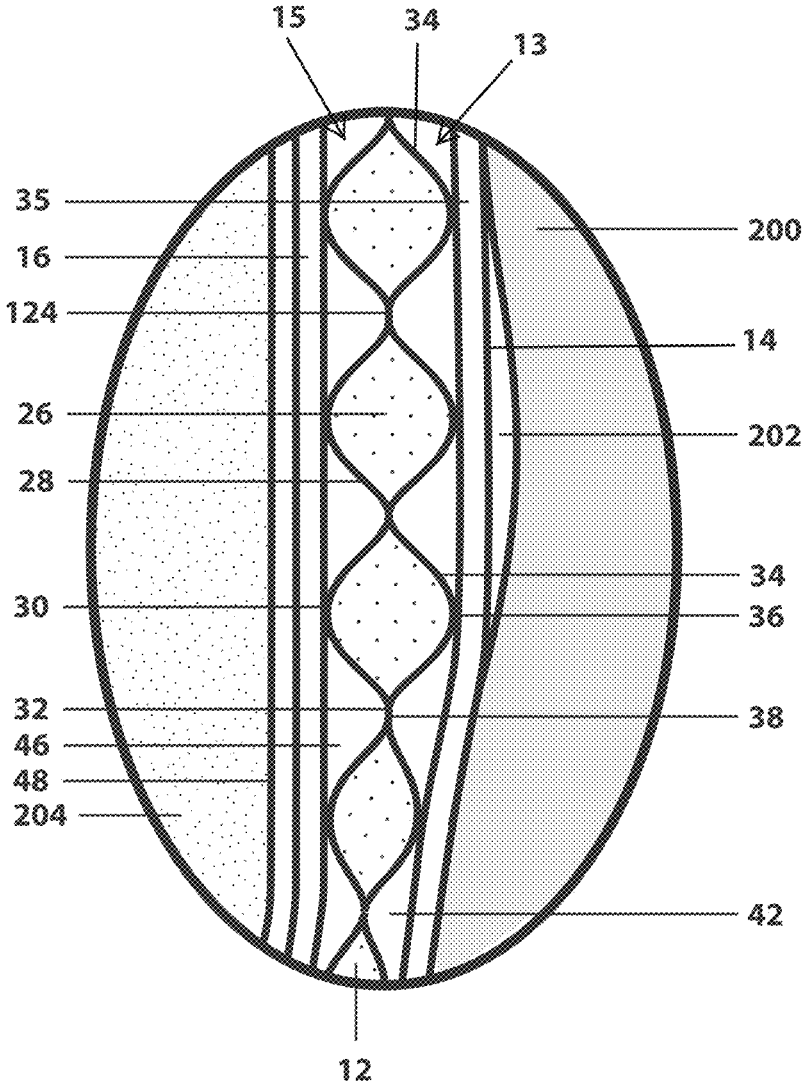
FIG. 3A is a section view of the second embodiment of inflatable survival vest of FIG. 3, when inflated.
Figure 3B:
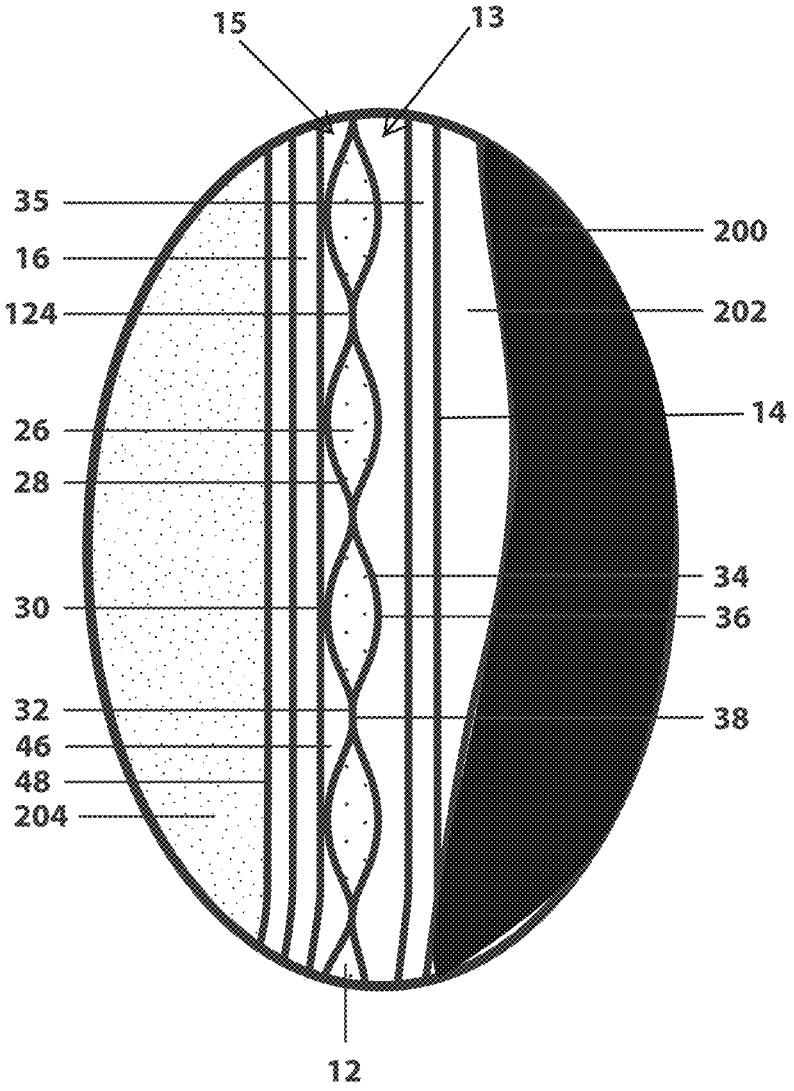
FIG. 3B is a section view of the second embodiment of inflatable survival vest of FIG. 3, when deflated.

Variations:

Referring to FIG. 3 through FIG. 3B, a variation, identified as survival vest 100, has been illustrated. This variation has two primary differences. A first difference relates to the orientation of the seams. Referring to FIG. 2, seams 24 of inflatable survival vest 10 were vertical seams. Referring to FIG. 3, inflatable survival vest 100 has been illustrated with seams 124 that extend horizontally. Referring to FIG. 3A and FIG. 3B, a second difference is the addition of an outer air chamber 15.

There follows a description which referring to FIG. 3 through 3B. As the vests are identical, except for the orientation of the seams, identical reference numerals have been used to identify identical elements.

Structure and Relationship of Parts:

Referring to FIG. 3, FIG. 3A and FIG. 3B, inflatable survival vest 100 consists of an inflatable bladder 12, an inner air chamber 13 (see FIGS. 3A and 3B) covered by an air retaining inner layer 14 and an outer air chamber 15 (see FIGS. 3A and 3B) covered by an air retaining outer layer 16. Inflatable bladder 12 has an inflation inlet 18 through which a gas is input to inflate inflatable bladder 12. Inflation inlet 18 is shown having a gas cylinder 20 connected to it, which is used to rapidly inflate inflatable bladder 12 in the event of an emergency. Inflatable bladder 12 is configured in the shape of a vest, generally indicated by reference numeral 22. Inflatable bladder 12 has a plurality of parallel seams 124 extending horizontally that divide inflatable bladder 12 into tubular channels 26. Referring to FIG. 3A and FIG. 3B, tubular channels 26 cause vest 22 to have a wavy outwardly facing surface 28 with crests 30 and troughs 32 and a wavy inwardly facing surface 34 with crests 36 and troughs 38.

Referring to FIG. 3, inner layer 14 has a peripheral edge 40. Inner layer 14 is secured along peripheral edge 40 to inflatable bladder 12. Referring to FIG. 3A, when inflatable bladder 12 is inflated, inner layer 14 overlies crests 36 of wavy inwardly facing surface 34 of vest 22 (see FIG. 3) and forms a plurality of inner air channels 42 in troughs 38 between inner layer 14 and wavy inwardly facing surface 34. In the illustrated embodiment, a porous non-compressible filler material 35 is used to fill inner air chamber 13 or at the very least placed adjacent to inner layer 14. The advantage of using filler material 35 is that it is non-compressible to ensure that inner air chamber 13 does not get choked off Air passes freely through filler material 35. There are various filler materials 35 that can be used. Beneficial results have been obtained through the use of "spacer fabrics", which are open, three dimensional knit fabrics. There spacer fabrics are available through suppliers, such as Gehring-Tricot. Beneficial results have also been obtained through the use of PVC coil fabrics, presently sold as carpet mats. These PVC coil fabrics are available in rolls through suppliers, such as Binzhou Worldking.

Referring to FIG. 3, outer layer 16 has a peripheral edge 44. Outer layer 16 is secured along peripheral edge 44 to inflatable bladder 12. Referring to FIG. 3A, when inflatable bladder 12 is inflated, outer layer 16 overlies crests 30 of wavy outwardly facing surface 28 of vest 22 (see FIG. 3) and forms a plurality of outer air channels 46 in troughs 32 between outer layer 16 and wavy outwardly facing surface 28.

Referring to FIG. 3, a shell 48 with limited stretch-ability overlies outer layer 16. Referring to FIG. 3A, shell 48 has limited stretch-ability and limits outward expansion of inflatable bladder 12 and serves to direct expansion of inflatable bladder 12 inwardly, forcing inner layer 14 against body 200.

Referring to FIG. 3, a circulation inlet 50 is provided into and an exhaust outlet 52 is provided out of inner air channels 42 and outer air channels 46. A breath input device, such as mouthpiece 54, is connected to circulation inlet 50. An exhaust valve forms part of exhaust outlet 52. The exhaust valve discharges excess air externally of inner air channels 42 and outer air channels 46. The exhaust valve is a one way valve that is pressure activated to open when the pressure exceeds pre-set limits. When the exhaust valve is closed, it prevents the entry of water. When the exhaust valve is open, the release of air prevents entry of water. The exhaust valve will not be further described, as suitable exhaust valves are known in the art and are commercially available. One example of a commercially available exhaust valve are the exhaust valves manufactured in various sizes for various applications under the Trademark brand SI-TECH.

Operation:

Referring to FIG. 3, vest 22 is intended to be worn in a normally deflated condition (as illustrated in FIG. 3B). Referring to FIG. 3, when vest 22 is immersed in water gas cylinder 20 is used to rapidly inflate inflatable bladder 12 within vest 22. Gas cylinder 20 can be manually activated or a liquid sensor can be provided with a valve that automatically causes gas cylinder to open the valve to inflate inflatable bladder 12 when liquid is sensed by the liquid sensor. Automated systems using liquid sensors is well known and, for that reason, will not be further described. It will be appreciated, that a simple blow tube can be used to inflate inflatable bladder 12. The manner of inflating inflatable bladder 12 is not essential to the present invention.

Referring to FIG. 3A, once inflatable bladder 12 is inflated, some immediate benefits are achieved. Firstly, expansion of inflatable bladder 12 forces inner layer 14 against a body 200 of a wearer. This eliminates or at very least reduces gaps 202 through which cold water 204 (or cold air for land applications) can circulate. A preferred material for inner layer 14 is neoprene. The use of shell 48, with limited stretch-ability, limits outward expansion of inflatable bladder 12 and serves to assist in directing expansion of inflatable bladder 12 inwardly forcing inner layer 14 against body 200, thereby making the seal more effective. Secondly, air is positioned in inner air channels 42 and outer air channels 46. This air has some insulation value.

When a person is immersed in cold water 204 for a prolonged period of time, the cold water 204 will cool the air positioned in outer air channels 46. This cold temperature will be transmitted to body 200 and the core temperature will decrease, resulting eventually in death. Referring to FIG. 3, a person wearing vest 22 is able to exhale into mouthpiece 54. Breath exhaled through mouthpiece 54 enters circulation inlet 50 and passes to exhaust outlet 52. Referring to FIG. 3A, breath input into circulation inlet 50 (shown in FIG. 3) is circulated through inner air channels 42 and outer air channels 46 before exiting exhaust outlet 52. Warm breath passing along inner air channels 42 serves to warm body 200 and slow the decrease in core temperature. Warm breath passing along outer air channels 46 provides a buffer which keeps the cold water away from inflatable bladder 12.

It will be apparent to persons skilled in the art that an inflatable survival vest can provide buoyancy and, if sufficient buoyancy is provided, may be certified as a personal floatation device (PFD). However, the same principle can be used to maintain core body temperature under cold weather conditions for land applications where buoyancy is not required. It will also be apparent to one skilled in the art that one could include arms that attach to the vest in order to provide some additional warmth in cold weather.

Figure 4:
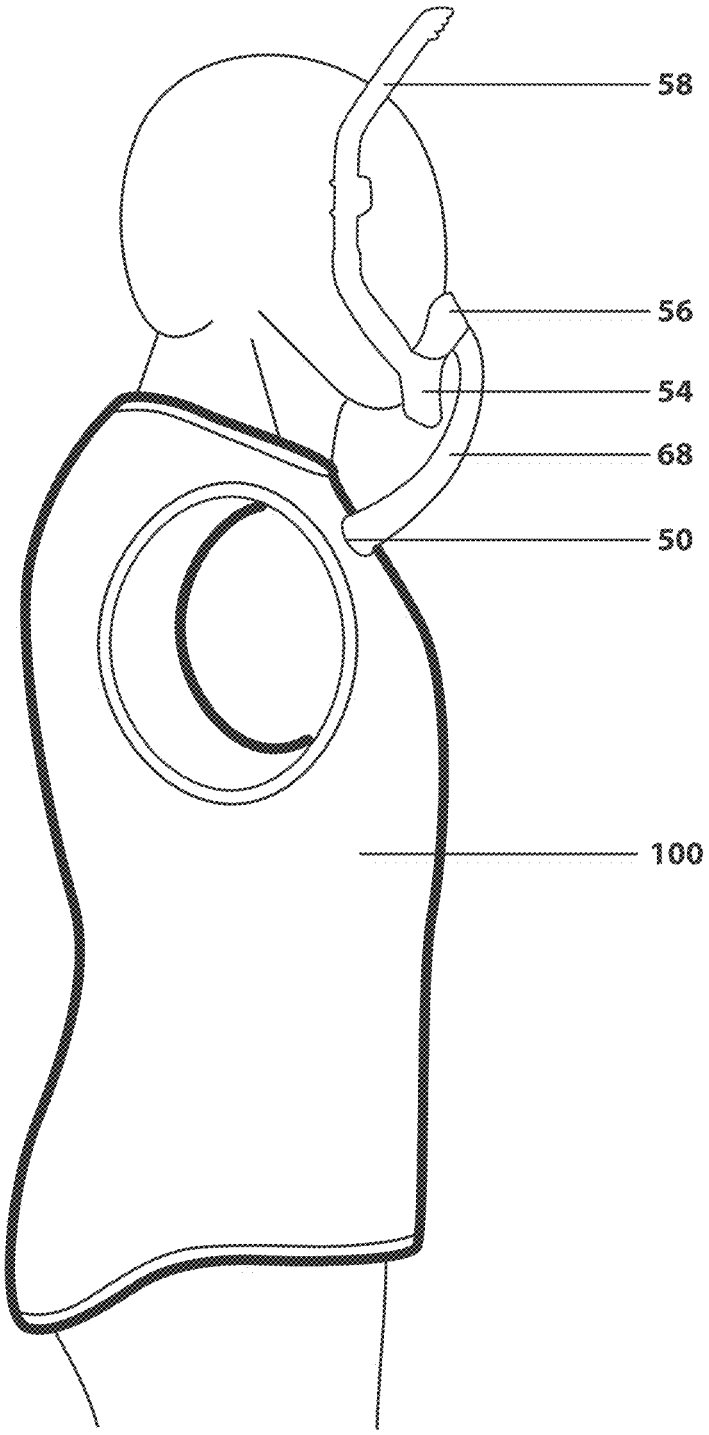
FIG. 4 is a side elevation view a snorkel breathing apparatus used with the first embodiment of FIG. 1.
Figure 4A:
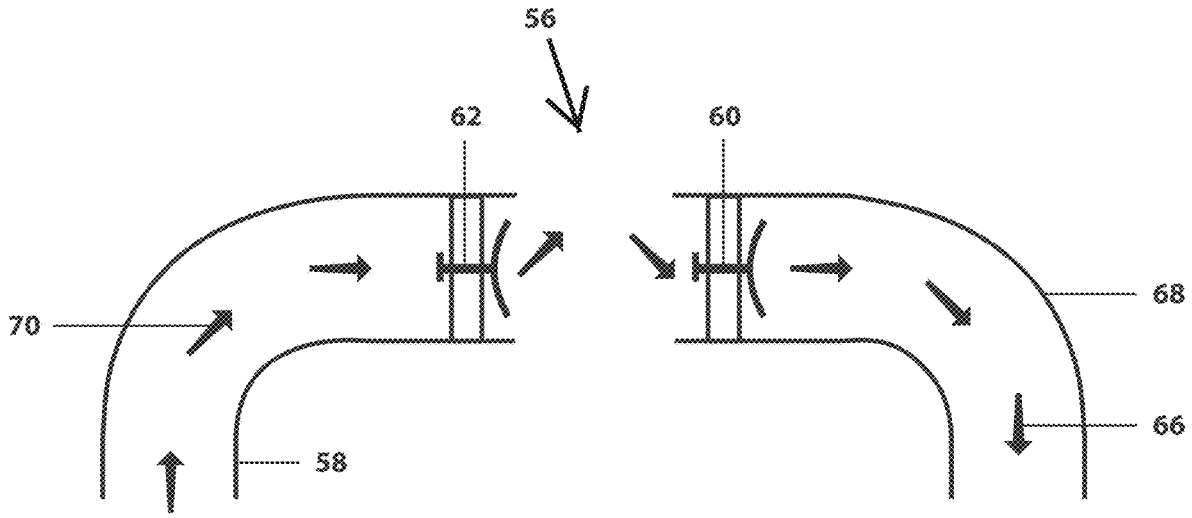
FIG. 4A is a top plan view, in section, of the snorkel breathing apparatus FIG. 4.

Referring to FIG. 4, in rough seas the onslaught of waves makes it difficult to breathe without swallowing water. In such applications, a snorkel tube 58 extends above the head of the wearer and connects to mouthpiece 54. Referring to FIG. 4A, in order to make breathing as effortless as possible, it is preferred that mouthpiece 54 be part of a breathing assembly 56. This breathing assembly 56 has a first one way valve 60 that allows exhaled breath 66 to pass from mouthpiece 54 along an exhale hose 68 which leads to the circulation inlet 50 into bladder 12 and prevents a reverse flow from bladder 12. A second valve 62 that permits fresh air 70 to flow through snorkel tube 58 when the wearer inhales and blocks air flow through snorkel tube 58 when the wearer inhales. In operation, when the wearer inhales through mouthpiece 54, second one way valve 62 opens to receive fresh air 70 from snorkel tube 58 and first one way valve 60 closes to that air is not drawn from bladder 12. When the wearer exhales through mouthpiece 54, first one way valve 60 opens to allow exhaled breath to pass along exhale hose 68 into circulation inlet 50 of bladder 12 and second one way valve 62 closes so that air is not sent up snorkel tube 58.

Figure 5:
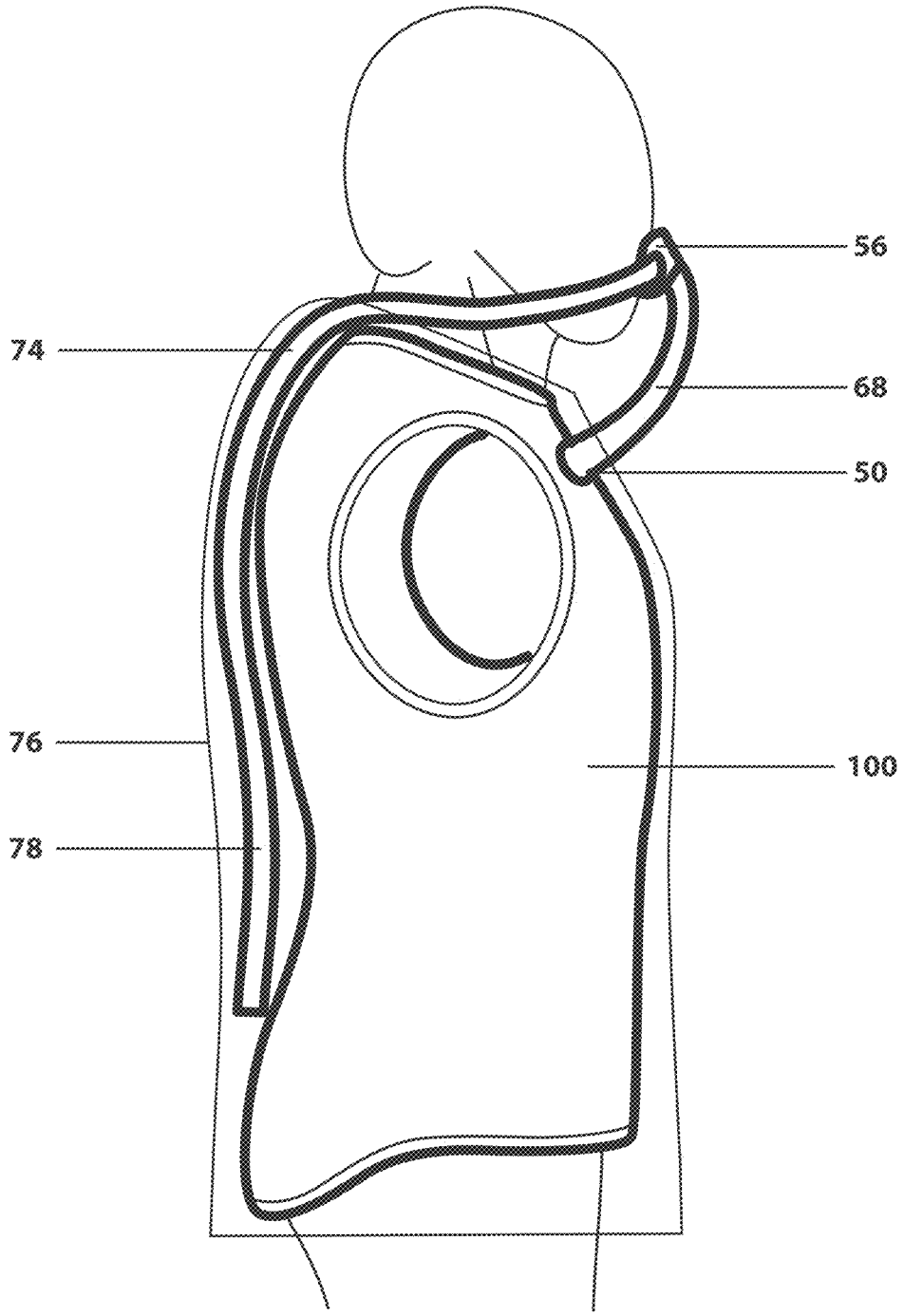
FIG. 5 is a side elevation view of a third embodiment of inflatable survival vest.
Figure 5A:
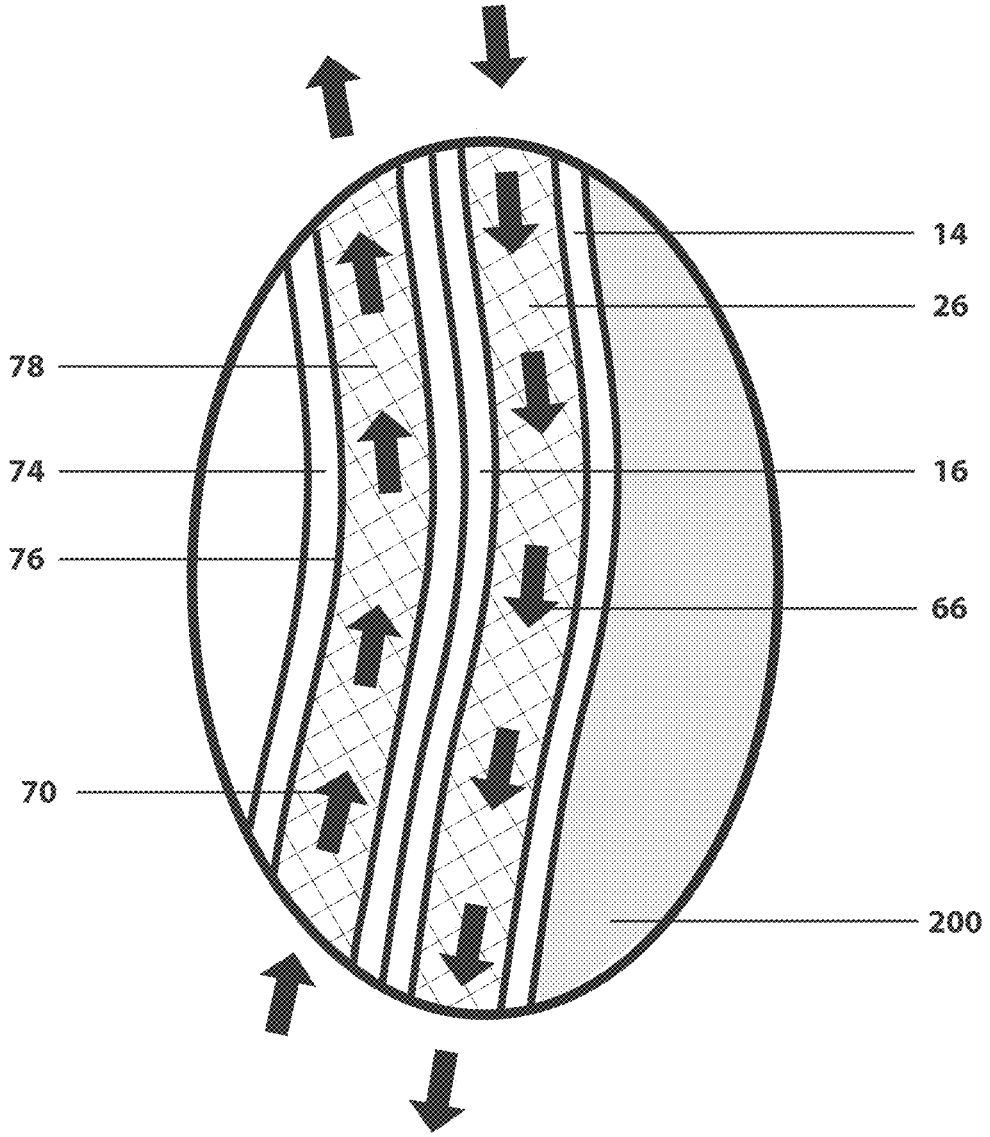
FIG. 5A is a section view of the third embodiment of inflatable survival vest of FIG. 5.

The inflatable survival vest is referred to as a "survival vest" rather than a floatation device, as it can be used on both land and water. When used on land, it is contemplated it would be used in extremely cold environments, such as the Arctic or Antarctic, the air is so cold that it can harm the lungs if not preheated. It is, therefore, desirable to preheat the air. Referring to FIG. 5, an air supply tube 74 is connected to a heat exchanger 76 built into survival vest 10. Referring to FIG. 5A, heat exchanger 76 consists of a passage 78 through which fresh air 70 is drawn. Passage 78 is positioned adjacent to bladder 12. As fresh air 70 passes along passage 78 it is preheated by a heat exchange with warmer exhaled air 66.

Test Results

Figure 6:
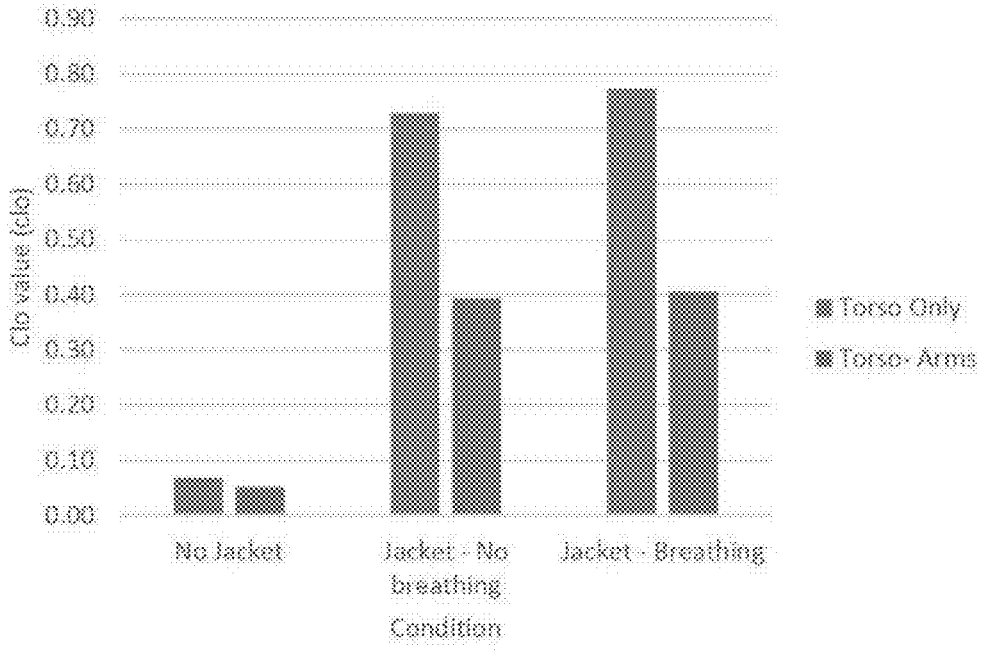
FIG. 6 is a graph of do value test results for the inflatable survival vest of FIG. 1 over street clothing.
Figure 7:
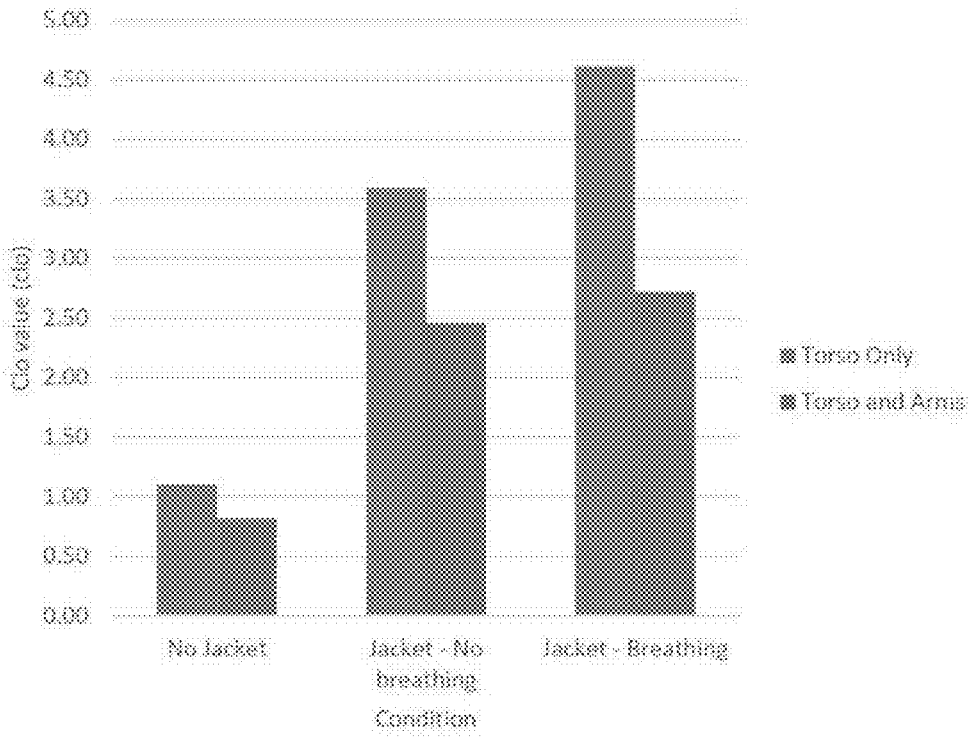
FIG. 7 is a graph of do value test results for the inflatable survival vest of FIG. 1 over street clothing and under an immersion suit.
Figure 8:
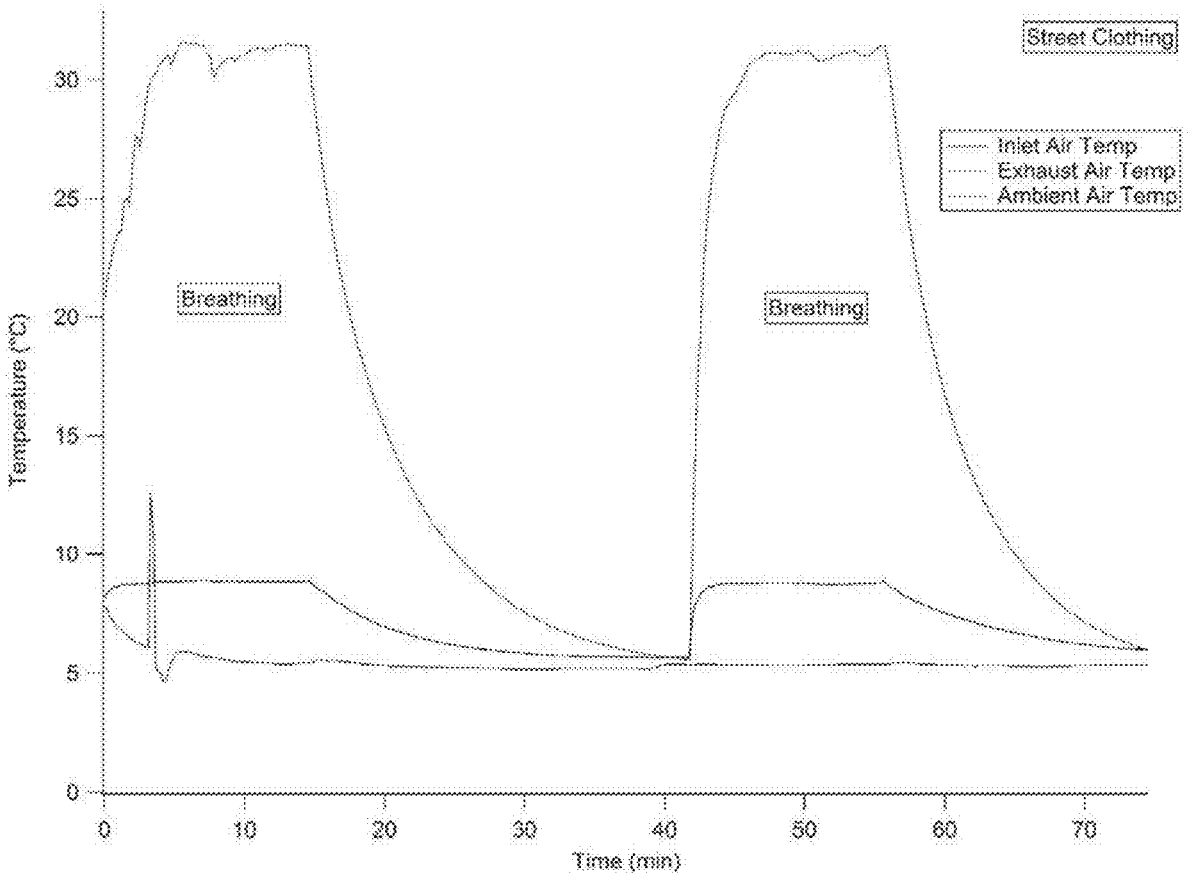
FIG. 8 is a graph of temperature monitoring test results for the inflatable survival vest of FIG. 1 over street clothing.
Figure 9:
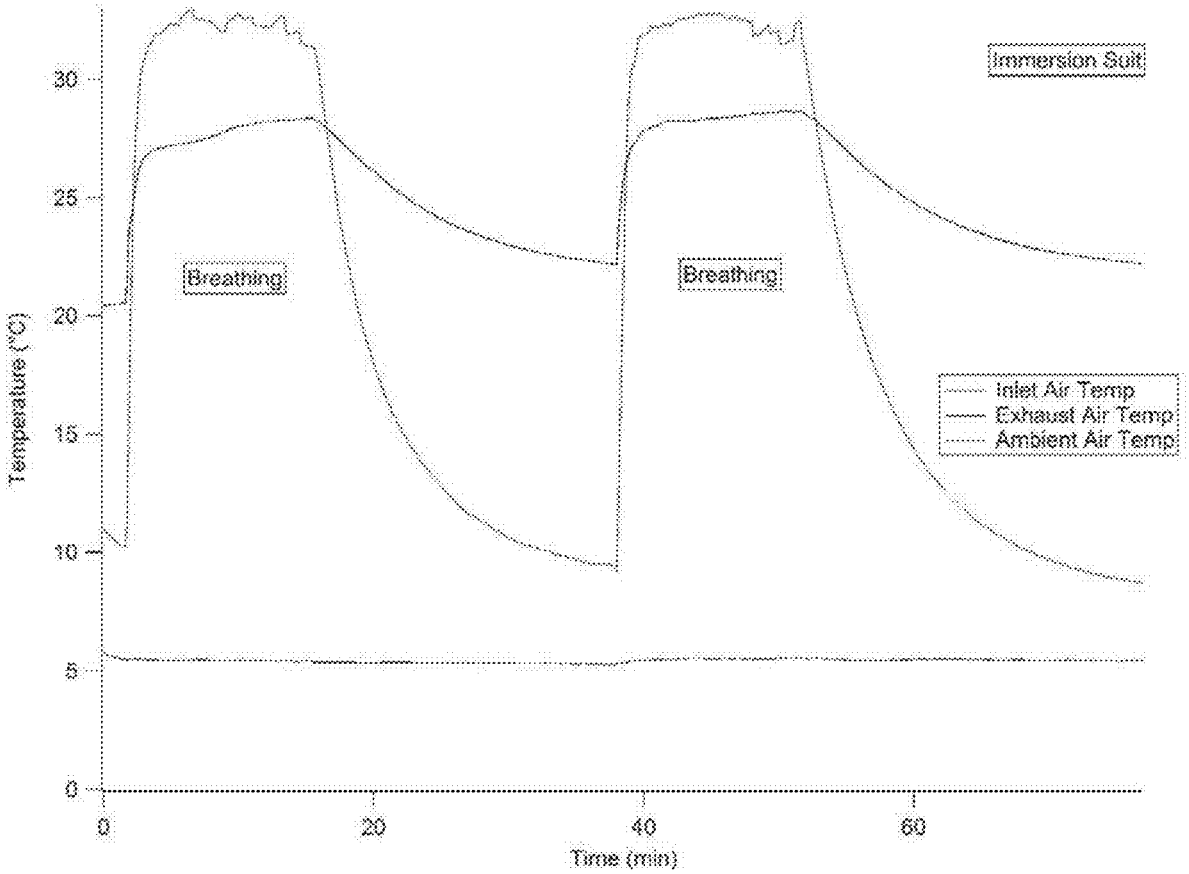
FIG. 9 is a graph of temperature monitoring test results for the inflatable survival vest of FIG. 1 over street clothing and under an immersion suit.

Tests were conducted by the National Research Council of Canada to determine the efficacy of survival vest 10 to delay the onset of hypothermia and increase survival time when a person was immersed in cold water having a temperature of 5 degree Celsius. The test results are summarized in FIG. 6 through FIG. 9. The tests were conducted on a manikin, as testing on a person was deemed to be too dangerous. The National Research Council has a manikin that has 23 programmable zones equipped with thermal sensors from which measurements may be taken. The majority of the tests were conducted until the manikin achieved a steady state (with less than 2% variation) for 30 minutes. As survival vest 10 covered the torso only, the surface areas that were the focus of testing were the chest, back, shoulders, abdomen and codpiece. FIG. 6 and FIG. 8 depict in graphic form the results tests conducted with the manikin was wearing survival vest 10 over street clothing. For the test, the street clothing consisted of underwear briefs, wool socks, cotton long sleeved pants, a cotton undershirt, a long sleeved cotton shirts, ankle high neoprene boots, neoprene gloves and a wool toque. FIG. 7 and FIG. 9 depict in graphic form the results of tests conducted on the same manikin with survival vest 10 positioned over the street clothing described above (minus the boots, gloves and toque) and under an immersion suit.

Clothing insulation may be expressed in Clo units. A do unit is similar to an R value used to rate insulation under in residential and commercial construction. 1 clo-0.155 L·m2·W−1. This is considered the amount of insulation that allows a person at rest to maintain a thermal equilibrium in an environment of 21 degrees Celsius in a normally ventilated room. Referring to FIG. 6, focusing on the torso only, the street clothing without survival vest 10 had a do value of 0.07 clo. Once survival vest 10 was placed over the street clothing, the do value increased to 0.73 clo, even before breathing was initiated into survival vest 10. Once breathing was initiated into survival vest 10, the do value increased to 0.77 clo, an increase of 5.4 percent. Referring to FIG. 7, focusing on the torso only, the street clothing inside of an immersion suit had a do value of 1.10 clo. Once survival vest 10 was placed over the street clothing and under the immersion suit, the do value increased to 3.59 clo, even before breathing was initiated into survival vest 10. Once breathing was initiated into survival vest 10, the do value increased to 4.61 clo, an increase of 28.4%. It is to be noted that the addition of survival vest 10 increased the do value of the street clothing and immersion suit from 1.10 clo to 4.61 clo; a factor of more than 4 times.

Referring to FIG. 8 and FIG. 9, temperature over time was monitored. For the tests, the water temperature was maintained at 5 degrees Celsius. The manikin was initially at 35 degrees Celsius. The temperatures monitored were ambient air temperature, inlet air temperature of air (breath) entering survival vest 10 and exhaust air temperature of air exiting survival vest 10. The ambient air temperature remained a constant 5 degrees Celsius. FIG. 8, depicts test results of the manikin dressed in street clothing, with survival vest 10 positioned over the street clothing. A person assisting with the test would inhale air at the ambient air temperature of 5 degrees and exhale breath in to the inlet of survival vest 10. This inlet air temperature hovered around 30 degrees Celsius. The air would pass through survival vest 10 and would be vented from survival vest 10 through an exhaust. The exhaust air temperature hovered around 8 degrees Celsius. FIG. 9, depicts test results of the manikin dressed in street clothing with survival vest 10 positioned over the street clothing and an immersion suit positioned over survival vest 10. A person assisting with the test would inhale air at the ambient air temperature of 5 degrees and exhale breath in to the inlet of survival vest 10. This inlet air temperature for survival vest 10 hovered around 30 degrees Celsius. The air would pass through survival vest 10 and would be vented from survival vest 10 through an exhaust. The exhaust air temperature hovered around 25 degrees Celsius.

It is believed that survival vest 10 will delay the onset of hypothermia and increase survival time in the following ways:

1. Upon inflation, survival vest 10 is pressed against a wearer's body. This seals, or at least greatly reduces any gaps through which water would otherwise enter. It is, therefore, believed that by inflating survival vest 10 prior to entering cold water, the initial shock of contact with cold water to the body may be eliminated or, at the very least, reduced.

2. Survival vest 10 serves to provide some insulation against cold water, as demonstrated by the do values in FIG. 6.

3. By breathing into survival vest 10, warm exhaled air at 30 degrees Celsius is circulated through survival vest 10, serving to further insulate and to some extent heat the wearer's body as demonstrated by the temperature monitoring data in FIG. 8. This reduces the rate at which the core temperature of the wearer's body cools.

4. Survival vest 10 can significantly improve the do value of an immersion suit, as demonstrated by the do values in FIG. 7 and the temperature monitoring temperatures in FIG. 9.

Tests were also conducted by a potential licensee Aqua-Lung Canada Inc. The purpose of the testing was to determine how effective the survival vest was when used to slow the cooling of human skin. For safety and liability reasons, the tests did not immerse the entire body of a person, only that portion of the body that was being tested. For the purpose of the test, a special "survival vest" was used that covered an arm. The arm was then immersed in ice water at 0 degrees Celsius (which was colder water than the NRC test). The temperature on the outside of the "survival vest" was monitored, the clothing covering the arm was monitored, and the skin under the clothing was monitored for a period of 30 minutes and temperatures taken at regular intervals. The temperature of the outside of the survival vest was 22.1 degrees Celsius at the first testing and then dropped rapidly due to exposure to ice water through 10 subsequent tests; fluctuating between 5 and 6 degrees as breath was input and exhausted from the "survival vest": (1) 9.7, (2) 6.4, (3) 5.7, (4) 5.2, (5) 5.5, (6) 5.2, (7) 5.4, (8) 6.4, (9) 6.4, and (10) 5.2. The temperature of the clothing sheltered underneath the survival vest was 32.3 degrees Celsius at the first testing and then dropped through 10 subsequent tests maintaining at around 25 degrees Celsius (1) 29.1, (2) 28.6, (3) 27.6, (4) 26.0, (5) 26.0, (6) 26.4, (7) 25.2, (8) 25.2, (9) 25.1, and (10) 25.2. The temperature of the skin underlying the clothing and the survival vest was 35.8 degrees Celsius at the first testing and then dropped slowly through 10 subsequent tests (1) 35.2, (2) 34.2, (3) 34.6, (4) 34.3, (5) 34.3, (6) 34.0, (7) 34.0, (8) 34.6, (9) 34.0, and (10) 33.2.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the claims should not be limited by the illustrated embodiments set forth as examples, but should be given the broadest interpretation consistent with a purposive construction of the claims in view of the description as a whole.

What is claimed is:

1. An inflatable survival vest, comprising:

an inflatable bladder having an inflation inlet through which a gas is input to inflate the bladder, the bladder being configured in the shape of a vest, the bladder having a plurality of parallel seams that divide the bladder into tubular channels, the tubular channels causing the vest to have a wavy outwardly facing surface with crests and troughs and a wavy inwardly facing surface with crests and troughs;

an inner air chamber positioned along the inwardly facing surface of the bladder; and a shell with limited stretch-ability overlying the inflatable bladder, thereby limiting outward expansion of the bladder such that the bladder is adapted to expand inwardly pressing the inner air chamber against a body of a person wearing the bladder.

2. The inflatable survival vest of claim 1, wherein the inner air chamber is comprised of an air retaining inner layer overlying the crests of the wavy inwardly facing surface of the vest and forming a plurality of inner air channels in the troughs between the inner layer and the wavy inwardly facing surface.

3. The inflatable survival vest of claim 2, wherein the inner air chamber is fill in whole or in part with a porous air permeable non-compressible filler material.

4. The inflatable survival vest of claim 1, wherein an outer air chamber is positioned along the outwardly facing surface of the bladder.

5. The Inflatable survival vest of claim 4, wherein the outer air chamber is comprised of an air retaining outer layer overlying the crests of the wavy outwardly facing surface of the vest and forming a plurality of outer air channels in the troughs between the outer layer and the wavy outwardly facing surface.

6. The inflatable survival vest of claim 1, wherein a circulation inlet is provided into and an exhaust outlet is provided out of the inner air chamber with a breath input device connected to the circulation inlet, whereby breath of the person wearing the vest is circulated through the inner air chamber from the circulation inlet to the exhaust outlet.

7. The inflatable survival vest of claim 6, wherein the breath input device is connected to a snorkel tube.

8. The inflatable survival vest of claim 7, wherein the breath input device has a first one way valve on an exhale tube and a second one way valve on the snorkel tube, the first one way valve closing and the second one way valve opening as a wearer inhales, the second one way valve opening and the second one way valve closing as the wearer exhales.

9. The inflatable survival vest of claim 6, wherein the breath input device is connected to a heat exchanger what preheats fresh air with a heat exchange with exhaled air.

10. An inflatable survival vest, comprising:

an inflatable bladder having an inflation inlet through which a gas is input to inflate the bladder, the bladder being configured in the shape of a vest, the bladder having a plurality of parallel seams that define tubular channels which causes the vest to have a wavy outwardly facing surface with crests and troughs and a wavy inwardly facing surface with crests and troughs;

an inner air chamber positioned along the inwardly facing surface of the bladder, the inner air chamber having a porous air permeable non-compressible filler material;

an outer air chamber positioned along the outwardly facing surface of the bladder;

a shell with limited stretch-ability overlying the outer layer, thereby limiting outward expansion of the bladder such that the bladder is adapted to expand inwardly pressing the inner air chamber against a body of a person wearing the bladder; and a circulation inlet is provided into and an exhaust outlet is provided out of the inner air chamber and the outer air chamber with a breath input device connected to the circulation inlet, whereby breath of the person wearing the bladder is circulated through at least one of the inner air chamber or the outer air chamber.

* * * * *